United States Patent [19]

Hata

[11] Patent Number: 4,756,669

[45] Date of Patent: Jul. 12, 1988

[54] AIR COMPRESSOR CONTROL APPARATUS

[75] Inventor: Yasuhisa Hata, Akashi, Japan

[73] Assignee: Nippon Air Brake Co., Ltd., Kobe, Japan

[21] Appl. No.: 76,806

[22] Filed: Jul. 23, 1987

[30] Foreign Application Priority Data

Jul. 31, 1986 [JP] Japan ..... 61-181273

[51] Int. Cl.[4] ..... F04B 49/00

[52] U.S. Cl. ..... 417/12; 417/44; 417/45; 60/418

[58] Field of Search ..... 417/10, 12, 34, 38, 417/44, 45, 53; 60/418

[56] References Cited

U.S. PATENT DOCUMENTS

| | | | |
|---|---|---|---|
| 1,346,898 | 7/1920 | Kingsbury | 417/36 X |
| 3,985,467 | 10/1976 | Lefferson | 417/44 X |
| 4,149,827 | 4/1979 | Hofmann, Jr. | 417/53 X |
| 4,201,517 | 5/1980 | Ferguson | 417/12 |
| 4,476,886 | 10/1984 | Haynes | 417/44 X |
| 4,518,316 | 5/1985 | Yokota | 417/44 X |

FOREIGN PATENT DOCUMENTS

| | | | |
|---|---|---|---|
| 85285 | 8/1983 | European Pat. Off. | 417/45 |
| 2717224 | 10/1978 | Fed. Rep. of Germany | 417/44 |
| 3118221 | 3/1982 | Fed. Rep. of Germany | 417/12 |
| 10171 | 1/1980 | Japan | 60/418 |
| 108886 | 6/1984 | Japan | 417/10 |

*Primary Examiner*—Carlton R. Croyle
*Assistant Examiner*—Paul F. Neils
*Attorney, Agent, or Firm*—J. O. Ray, Jr.

[57] ABSTRACT

An air compressor pressure adjustment device designed such that any values between two set points are determined and used as first and second standard values. When the air pressure in the reservoir decreases to the first standard value the air compressor is driven at a low speed. When the air pressure increases in the reservoir and reaches an upper limit set point the compressor is turned off. When this air pressure decreases to less than the lower limit set point, the air compressor is started once more.

3 Claims, 2 Drawing Sheets

PRIOR ART

AIR COMPRESSOR CONTROL APPARATUS

FIELD OF THE INVENTION

The present invention relates, in general, to a railway car air supply system used to supply air pressure to designated pneumatic equipment such as the air brake system, the air springs, and an automatic door opening/-closing system, etc., and, more particularly, the invention relates to a pressure adjustment apparatus to control the starting and stopping of the air compressor forming a part of the air supply system.

BACKGROUND OF THE INVENTION

Air consumption in a railway car is primarily the result of the above-mentioned pneumatically-operated equipment. However, its consumption varies considerably depending on the operating condition of the railway car (express or the local which stops at every station), the time (rush hour or non-rush hour) and the route condition (slope, curve and distance between the stations), etc. Normally, the rate of operation of the air compressor is approximately 30%; however, it changes to approximately 20–40% depending on the conditions described above. Despite the high or low air consumption, the operation of the air compressor in the prior art is always operated at the rated level (full operation), and its sudden starting causes a reaction in the car body by the inertial force of the motor and the compressor, so that, in some cases, it can cause vibration of the car body and potential discomfort to the passengers. At the same time, the vibration of the compressor itself is significant, so that the piston rings or ball bearings will generally wear out rapidly. In addition, the frequency of starting and stopping of the compressor is high and its start-up current is high, so that electrical power consumption increases; furthermore, the principal contactor rapidly experiences wear, and the compressor starting device consisting of the principal contactor, the series resistor and breaker, becomes quite large.

The prior art includes Japanese Utility Model No. 60-16971, and the following is a detailed explanation of the pressure adjustment method of this particular prior art system, with reference to the accompanying FIGS. 3 and 4.

FIG. 3 is a graph which indicates the air pressure in the air reservoir and the starting and the stopping of the railway car air supply system air compressor, and FIG. 4 is a schematic diagram of the air supply system including the pressure adjustment device.

As can be seen in FIG. 4, the system includes an air compressor 1, and air reservoir 2, a check valve 3, in which the forward direction is the direction of the air reservoir 2. An air adjustment device 4 is provided which detects the air pressure P in the air reservoir 2. In this prior art air supply system, the driving device 5 starts and stops the air compressor 1 depending on the electrical signal coming from the pressure adjustment device 4. The pressure adjustment device 4 is electrically designed so that it can have the same function as the pressure switch indicated in the above-mentioned Japanese Utility Model Patent No. 60-16971. The pressure adjustment device 4 consists of the sensor 11 which converts the air pressure P in the air reservoir 2 to the electrical signal E11, of the deformation gauge. The comparison part 17 has a hysteresis characteristic and makes the output E17 (L) when the air pressure P rises to the upper limit set point P4 and makes the output E17 (H) when the air pressure P decreases to the lower limit set point P1. The output part 18 is operated by the output E17 of this comparison part 17, and is equipped with a transistor or relay, etc. Furthermore, both above-mentioned set points P1 and P4 can be determined freely by the variable resistor VR1, VR4, of the comparison part 17. In addition, the drive device 5 includes a principal contactor (relay) or a series resistor, etc. In addition, the dust filter, the muffler, the aftercooler, and the moisture remover, etc. (designated "auxiliaries" below) are located around the air compressor 1, but they are not illustrated in the figure. In FIG. 3, time t0–t11 indicates the first charging time. When the power is supplied from the power source (not shown in the figure) at the time t0, since the air pressure P in the air reservoir 2 is atmospheric, the pressure adjustment device 4 detects this condition and the air compressor 1 is operated at its rated capacity, and the air pressure P rises. When the air pressure P reaches the upper limit set point P4 at time t11, the pressure adjustment device 4 detects this, and the air compressor 1 stops. After that, the air pressure P decreases due to the air consumption by the pneumatic equipment, and when it becomes less than the lower limit set point P1 at time t12, the pressure adjustment device 4 detects this condition, and the air compressor 1 is once again operated at its rated capacity. Thus, by starting and stopping the air compressor 1, the air pressure P in the original air reservoir 2 is adjusted between the lower limit set point P1 and the upper limit set point P4.

SUMMARY OF THE INVENTION

The present invention teaches a pressure adjustment system for a railway car in which any values between two set points are determined to be the first and second standard values. When the air pressure in the air reservoir decreases and reaches the first standard value, the air compressor is driven at low speed, that is, at a lower number of revolutions than the rated number of revolutions, and when the air pressure in the air reservoir increases as a result of the low speed operation and reaches the upper limit set point the air compressor is turned off. When this air pressure decreases and becomes less than the lower limit set point, the air compressor is driven at the rated operating speed, and when the air pressure in the air reservoir increases by this rated operating speed and reaches the second standard value, the air compressor is once again driven at low speed. Such a pressure adjustment method for a railway car is particularly useful when the air pressure in the air reservoir which is connected to the air pressure machinery such as the air brake system, etc., increases, and reaches the upper limit set point, the air compressor is turned off, and when this air pressure decreases and becomes less than the lower limit set point, the air compressir is once again operated at its rated speed.

OBJECTS OF THE INVENTION

It is, therefore, one of the primary objects of the present invention to provide a pressure adjustment apparatus and method which will reduce the number of start and stops of an air compressor forming a part of an air supply system of a railway car.

Another object of the present invention is to provide a pressure adjustment apparatus which will reduce energy consumption of an air compressor.

Still another object of the present invention is to provide a pressure adjustment apparatus which will reduce wear of an air compressor due to minimizing the number of starts and stops of such air compressor.

A further object of the present invention is to provide a pressure adjustment apparatus which will reduce the frequency of extreme vibration of an air compressor due to sudden starting from a stopped condition.

The above and various other objects and advantages of the present invention will become more readily apparent to those persons skilled in the air compressor art from the following more detailed description of the pressure adjustment apparatus when such description is taken in conjunction with the attached drawings and with the appended claims.

BRIEF DESCRIPTION OF THE INVENTION

Figure 1:
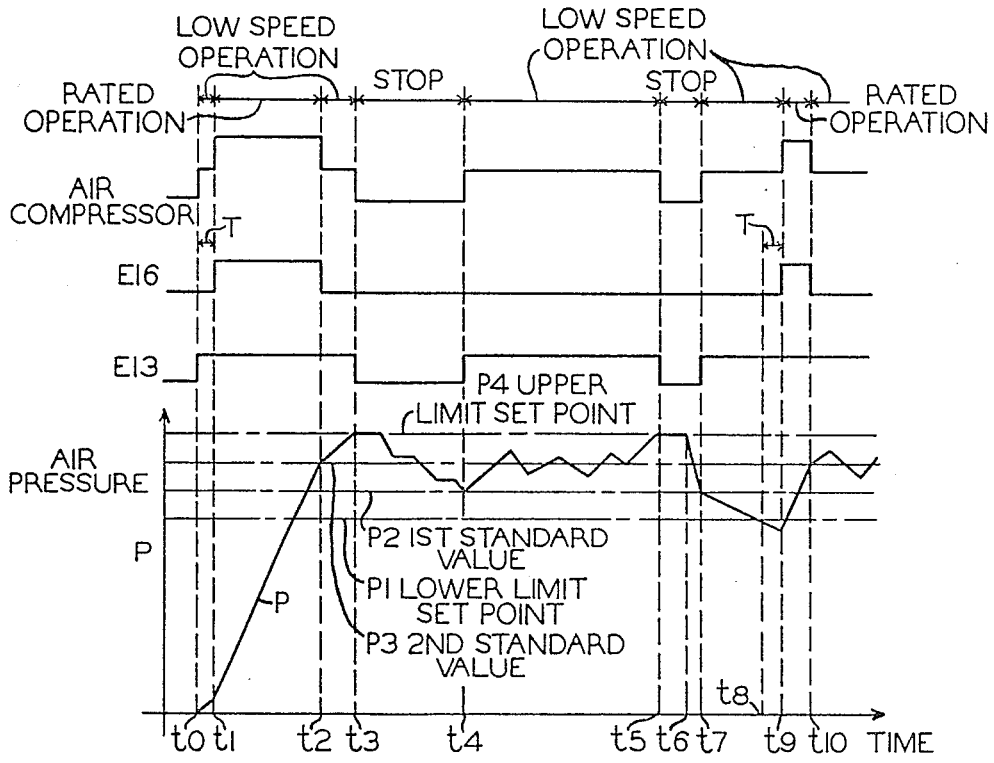
FIG. 1 is a graph illustrating the relationship between the air pressure, as indicated by a first output signal value and a second output signal value of a pressure adjustment device, and a starting and stopping pressure values of an air compressor according to one presently preferred embodiment of the invention.
Figure 2:
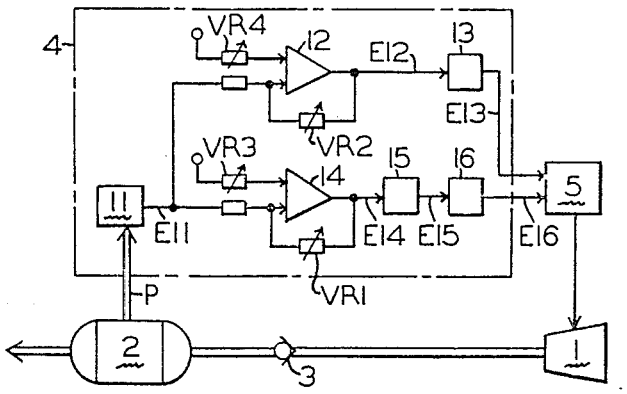
FIG. 2 is a schematic diagram of one embodiment of an air supply system which can be operated according to the relationship illustrated in FIG. 1.
Figure 3:
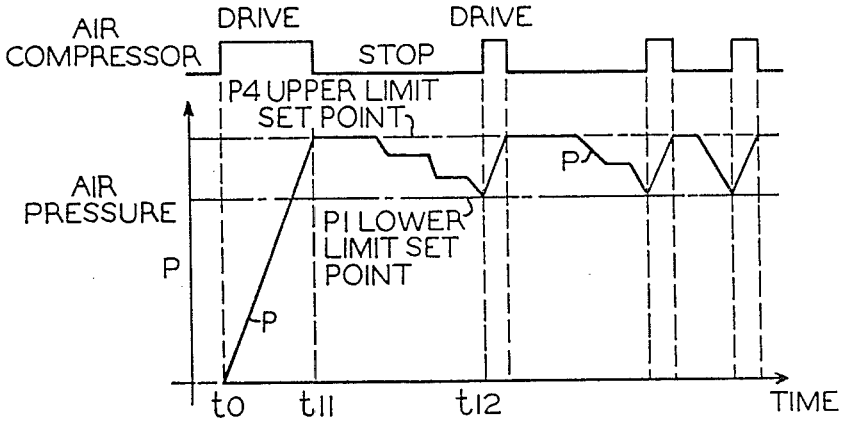
FIG.3 PRIOR ART
FIG. 3 is a graph indicating the relationship of the air pressure and the starting and stopping pressure of an air compressor operated according to the practices of the prior art.
Figure 4:
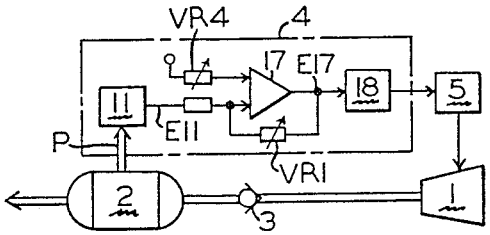
FIG. 4 is a schematic diagram of the prior art equipment used to operate an air supply system according to the relationship illustrated in FIG. 3.

Now refer more particularly to the schematic diagram of FIG. 2 which depicts an air supply system which includes the pressure adjustment device of a presently preferred embodiment of the invention and to the graph of FIG. 1 which indicates the air pressure P, the outputs E13 and E16 of the pressure adjustment device and the starting and stopping limits of the air compressor.

As illustrated in FIG. 2, the pressure adjustment apparatus consists of a sensor 11 connected to determine the amount of air pressure in an air reservoir 2. The air reservoir 2 is connected to receive air from an air compressor 1 through a check valve 3. The sensor 11 provides an output signal E11, having a value representative of the air pressure in reservoir 2, to an input side of a first comparator means 12 and to an input side of a second comparator means 14. Connected to a second input side of comparataor means 12 is a variable resistor 4 and connected to a second input side of comparator 14 is a variable resistor 3. An output signal E12, used for low speed operation, is connected to a first signal output device 13. A variable resistor 2 is connected between the output signal line E11 of the sensor 11 and the output signal line E12 of the comparator means 12. A signal E13 is transmitted from the first signal output means 13 to an electric drive motor 5 which is connected to the compressor 1. An output signal E14, used to operate the compressor at rated capacity, is connected to a timer 15 which is connected to a second output signal means 16. A variable resistor 1 is connected between the output signal line E11 of the sensor 11 the output signal line E12 of the seond comparator means 14. A signal E16 is transmitted from the second signal output means 16 to the electric drive motor 5. The first comparator means 12 has a hysteresis characteristic such that when the air pressure rises and reaches the upper limit set point P4, it makes the output E12 (L), and when the air pressure P decreases and assumes a value less than the first standard value P2, it makes its output E12 (H). This upper limit set point P4 and the first standard value P2 can be set freely using the variable resistor VR4, VR2.

The second comparator means 14 has a hysteresis characteristic such that when the air pressure P rises and reaches the second standard value P3, it makes its output E14 (L), and when the air pressure P drops and assumes a value less than the lower limit set point P1, it makes its output E14 (H). This second standard value P3 and the lower limit set point P1 can be set freely using the variable resistor VR3, VR1. In this embodiment they are set as $P1<P2<P3<P4$.

The time 15 is the "delayed on" type, and when its input E14 becomes (H) it makes its output E15 (H) after a predetermined time T (for example 1–3 seconds), and when its input E14 becomes (L) it immediately makes its output E15 (L).

The electric drive motor 5 preferably sets E16 to (H) for rated operation for the case when the output E13 of the above-mentioned pressure adjustment device 4 and (H) signal of E16 are input. In FIG. 1, the time t0–t3 indicates the first pressurization time. When the electric power is supplied at time t0, since the air pressure P in the original air reservoir 2 is atmospheric, inside the pressure adjustment device 4, both outputs E12, E14, of both comparator means 12, 14 become (H) and the first output E13 becomes (H). However, on account of the function of the timer 15, the second output E16 remains (L), and the air compressor 1 is started at low speed.

At the time t1, which is the time after the predetermined time T of the timer 15 has passed, the second output E16 becomes (H) and this has the preference in the electric drive motor 5 so that the air compressor 1 is switched to rated operation and the air pressure rises rapidly. When this air pressure P reaches the second standard value P3 at the time t2, in the pressure adjustment device 4 the output E14 of the second comparator means 14 becomes (L) and the second output E16 becomes (L) so that, because the first output E13 is (H), the air compressor 1 is switched back to low speed operation again, and the rising speed of the air pressure P slows. When the air pressure P reaches the upper limit set point P4 at the time t3, in the pressure adjustment device 4, the output E12 of the first comparator means 12 becomes (L) and the first output E13 becomes (L), so that the air compressor 1 stops.

During subsequent operation of the car, the air is consumed intermittently so that the air pressure P decreases to the first standard value P2 at the time t4. At this time, in the pressure adjustment device 4, the output E12 of the first comparator means 12, becomes (H) and the first output E13 becomes (H), so that the air compressor 1 is operated at low speed and the air pressure P increases gradually. When the air is consumed again while the air pressure is rising, the air pressure P decreases; however, if its consumption is in the normal state, it does not decrease to the lower limit set point P1, and the air compressor 1 operates continuously at low speed. The time t4–t5 indicates this condition.

If the car stops at a station for a long time during low speed operation of the air compressor 1 and no air is consumed, the air pressure P increases and reaches the upper limit set point P4 at the time t5, then the first output E13 of the pressure adjustment device 4 becomes (L) and the air compressor 1 stops. When the air consumption suddenly increases due to the sudden increase in the number of passengers getting on and off, etc., and the air pressure rapidly decreases from time t6 and reaches the first standard value P2 at time t7, the first output E13 of the pressure adjustment device 4 becomes (H) and the air compressor 1 is operated at low speed, and the rate of decrease of the air pressure P becomes slower. When the air pressure P decreases further despite this low speed operation and reaches the lower limit set point P1, at time t8, in the pressure adjustment device 4, the output E14 of the second comparator means 14 becomes (H), however, because of the operation of the timer 15, the second output E16 remains (L).

At the time t9, which is the time after the predetermined time T of the timer 15, has elapsed, the second output E16 becomes (H) and the air compressor switches to rated operation so that the air pressure P increases rapidly.

When the air pressure P reaches the second standard value P3 at time t10, the second output E16 becomes (L) and by the first output E13 (H), the air compressor 1 switches to low speed operation once again.

The status of normal car operation is t4–t5 or t3–t6, and the state of t9–t10 in which the air compressor 1 is at rated operation is either a rapid increase of the passengers getting on and off the train or an emergency, which is very rare. In the embodiment described above, the relationship between the first standard value P2 and the second standard value P3, is $P2<P3$; however, it can also be $P2<P3$ or $P2=P3$. In addition, the timer 15 is used in the above-described embodiment, however, it relates primarily to the initial pressurization time of t0–t3, and it can be eliminated if necessary. Furthermore, the relationship of (H), (L) of each outut in the pressure adjustment device 4 in the embodiment described above can be changed freely, as a function of the individual installation.

In the operation of the invention described above, in the normal air consumption status which represents the majority of the operation of the car, the starting and stopping of the air compressor is very infrequent and its opertion also continues at low speed, so that the level of noise and vibration is low, and the life of the piston rings or the bearings of the compressor can be increased, and the vibration of the car body also decreases, which makes the passengers more comfortable. At the same time, the starting current for low speed operation can be reduced, so that the principal contactor of the starting device will not be subjected to such severe wear, and this principal contactor or breaker can be reduced in size; it might even be possible to eliminate the series resistor. In addition, even if the air consumption increases temporarily due to the various above-mentioned conditions during cap operation, since the origingal air reservoir can be supplemented immediately by the rated operation of the air compressor, safety can be maintained.

Therefore, in this invention, under normal conditions, the air compressor is operated substantially continuously at low speed, a the lowest possible number of revolutions, and there are no sudden starts or frequent starting and stopping, and when the air consumption increases temporarily, the air compressor is driven at its rated level to supplement the original air reservoir quickly. The invention is characterized by the fact that any values between the above-mentioned two set points are the first and second standard values, and when the air pressure in the original air reservoir decreases and reaches the first standard value, the air compressor is driven at low speed at a number of revolutions lower than the rated number of revolutions, and when the air pressure in the original air reservoir increases in response to this low speed operation and reaches the upper limit set point, the air compressor is stopped, and when this air pressure descrease and drops below the lower limit set point, the air compressor is driven at the rated operating speed, and when the air pressure in the original air reservoir increases in response to this rated operation and reaches to the second standard value, the air compressor is driven at low speed again, in contrast to the pressure adjustment apparatus of the prior art.

According to the method described above, in normal car operation, when the air pressure in the original air reservoir decreases to the first standard value which is higher than the lower limit set point, the air compressor is driven at low speed, so that the air pressure increases gradually without decreasing to the lower limit set point, and if the air is consumed while the pressure is increased, the air pressure does not reach the upper limit set point, so that the air compressor is continuously driven at low speed.

If the air consumption is low, when the air pressure reaches the upper limit set point, the air compressor stops, and when it decreases to the first standard value, the air compressor is once again driven at low speed, and intermittently. When the air pressure decreases and beocmes less than the lower limit set point as a result of the temporary increased air consumption during low speed operation of the air compressor, the air compressor is driven at the rated level of operation and the air pressure increases rapidly, and when it reaches to the second standard value, the air compressor is once agian switched to low speed operation. Therefore, the air compressor is not started at the rated speed, and at the same time, during most of the operation of the car, the air compressor is driven at low speed, and the frequency and the duration of rated operation can be significantly decreased.

While a presently preferred embodiment of an air compressor pressure adjustment apparatus and method of operation have been described in detail above, it should be understood by those persons skilled in the air compressor art that other modifications and adaptations can be made without departing from the spirit and scope of the appended claims.

I claim:

1. A pressure adjustment device for an air compressor of a railway car air supply system, said pressure adjustment device comprising:

(a) a pressure sensor connected to an air reservoir in such air supply system to determine an air pressure in such air reservoir and to transmit a signal having a value that is representative of such air pressure;

(b) a first comparator means connected to receive said signal from said pressure sensor for comparing said value with a first predetermined value;

(c) a first means connected to said first comparator means for providing said first predetermined value;

(d) a first signal output means connected to receive a signal from said first comparator means for passing a first control signal to an air compressor drive motor based on said signal received from said first comparator means;

(e) a second comparator means connected to receive said signal from said pressure sensor for comparing said value with a second predetermined value;

(f) a second means connected to said second comparator means for providing said second predetermined value;

(g) a second signal output means connected to receive a signal from said second comparator means for passing a second control to such air compressor drive motor based on said signal received from said second comparator means;

(h) a timer connected intermediate said second comparator means and said second signal output means;

(i) a variable resistor connected at a first end thereof to said signal from said sensor and at a second end thereof to said signal from said first comparator means; and (j) a variable resistor connected at a first end thereof to said signal from said sensor and at a second end thereof to said from said second comparator means.

2. A pressure adjustment device, according to claim 1, wherein at least one of said first predetermined value and said second predetermined value is variable and at least one of said first means and said second means is a variable resistor.

3. A pressure adjustment device, according to claim 2, wherein each of said first predetermined value and said second predetermined value are adjustable and both said first means and said second means are variable resistors.

* * * * *

UNITED STATES PATENT AND TRADEMARK OFFICE

CERTIFICATE OF CORRECTION

PATENT NO. : 4,756,669

DATED : July 12, 1988

INVENTOR(S) : Yasuhisa Hata

It is certified that error appears in the above-identified patent and that said Letters Patent are hereby corrected as shown below:

Column 8, line 5, after "said", first occurrence, insert -- signal --.

Signed and Sealed this

Sixth Day of December, 1988

*Attest:*

*Attesting Officer*

DONALD J. QUIGG

*Commissioner of Patents and Trademarks*